United States Patent [19]

Griesenbrock et al.

[11] Patent Number: 4,506,764

[45] Date of Patent: Mar. 26, 1985

[54] LIFT TRUCK

[75] Inventors: Karl-Heinz Griesenbrock, Stuvenborn; Bernd David, Henstedt-Ulzburg; Carsten Petersen, Bark, all of Fed. Rep. of Germany

[73] Assignee: Firma Jungheinrich Unternehmensverwaltung KG, Hamburg, Fed. Rep. of Germany

[21] Appl. No.: 314,008

[22] Filed: Oct. 22, 1981

[51] Int. Cl.[3] ..... B66B 9/20

[52] U.S. Cl. ..... 187/9 E; 414/631

[58] Field of Search ..... 187/9 R, 9 E; 414/631, 414/629, 785

[56] References Cited

U.S. PATENT DOCUMENTS

| | | | |
|---|---|---|---|
| 2,855,071 | 10/1958 | Arnot | 187/9 E |
| 3,116,812 | 1/1964 | Farmer et al. | 187/9 E |
| 3,338,335 | 8/1967 | McNeeley | 187/9 E |
| 3,394,778 | 7/1968 | Brinton | 187/9 E |
| 4,191,276 | 3/1980 | Farmer et al. | 187/9 E |
| 4,374,550 | 2/1983 | Bartow | 187/9 E |

FOREIGN PATENT DOCUMENTS

| | | | |
|---|---|---|---|
| 2020276 | 2/1963 | Fed. Rep. of Germany . | |
| 1060321 | 8/1968 | Fed. Rep. of Germany . | |
| 2926657 | 1/1981 | Fed. Rep. of Germany | 187/9 E |
| 1168496 | 1/1957 | France . | |
| 1591004 | 3/1970 | France . | |
| 2405894 | 10/1978 | France . | |
| 772610 | 4/1957 | United Kingdom . | |
| 807940 | 1/1959 | United Kingdom . | |
| 2045208 | 8/1969 | United Kingdom . | |
| 1250630 | 10/1971 | United Kingdom . | |

*Primary Examiner*—Joseph J. Rolla
*Assistant Examiner*—Kenneth Noland
*Attorney, Agent, or Firm*—Toren, McGeady and Stanger

[57] ABSTRACT

A lift truck has a lifting mast and a lifting cylinder arrangement, which is located either in front of or behind an upright of the mast and defines a dead angle for the operator of the vehicle in the operator's station. A load chain is connected to a central point of the load carrier and a chain guide roller arrangement extends obliquely to the lateral extent of the mast. The invention is applicable to masts which are nonextensible and to telescopic masts having one or more extensible sections.

7 Claims, 10 Drawing Figures

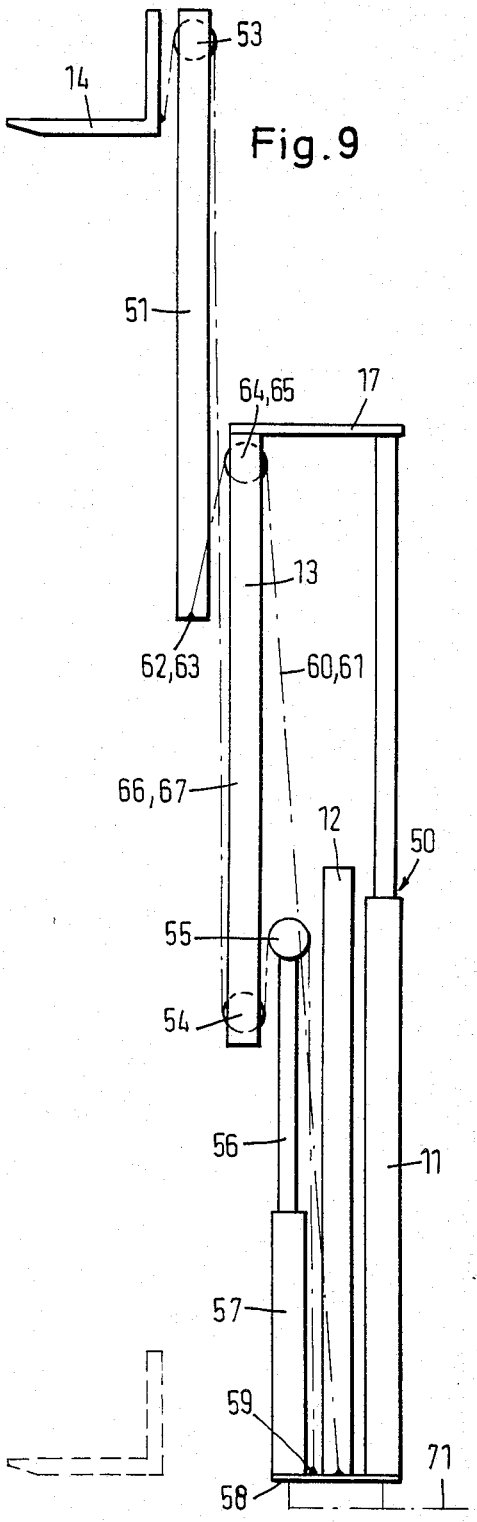
Fig.9
Fig.8
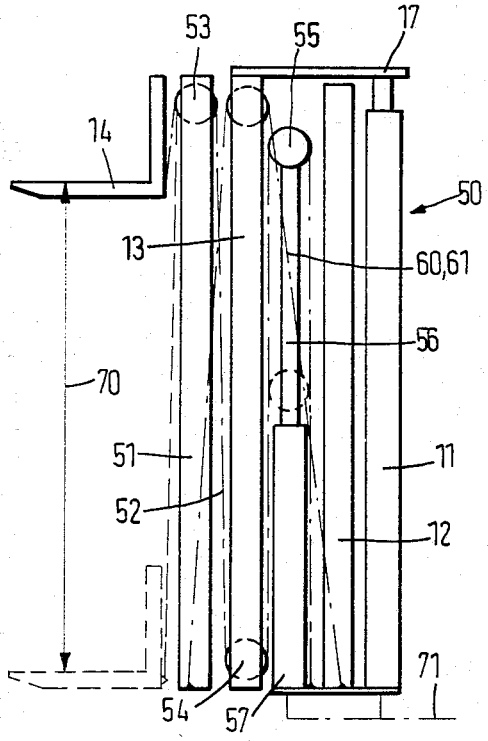

LIFT TRUCK

The invention relates to lift trucks.

It is known to modify lift trucks having a conventionally constructed telescopic lifting mast and a lifting cylinder arranged centrally or substantially centrally between the uprights of the mast so as to improve the visibility in that instead of this one cylinder for a dead lift and main lift at least two lifting cylinders are arranged adjacent to the uprights of the mast, and load chains which are independently guided and reversed are provided for each cylinder arrangement. The larger construction costs associated therewith as well as the lower degree of overall effectiveness makes this design disadvantageous.

Often, with still greater disadvantage, because it again restricts the visibility in various positions, it is necessary in a multiple telescopic lifting mast to provide in addition to the lateral cylinder arrangement a still further cylinder for the achievement of a large dead lift. As that further cylinder is carried by a vertically movable part, the hydraulic connections to said cylinder must be vertically movable too so that the reliability in operation is reduced.

An object underlying the present invention is to provide a lifting truck having a lifting mast which either guides only a load carrier or includes at least one extensible mast and is constructed as a frame, and has a simple chain arrangement and as a result of an ingenious design in combination with the design of the vehicle makes possible a wide field of view through the framelike lifting mast, which can be supplemented to constitute a telescopic lifting mast, whereas a lifting cylinder arrangement which is relatively small in diameter does not restrict the field of view and there are no vertically movable hydraulic cylinder connections.

In accordance with the invention, there is provided a lift truck having a lifting cylinder arrangement arranged on one side of the central longitudinal axis of the lift truck on a frame type lifting mast, at least one load chain connecting the lifting cylinder arrangement to a central point of a load carrier, and an operator's station arranged asymmetrically behind the lifting mast, wherein the lifting cylinder arrangement is arranged in a given dead angle in front of or behind an upright of the lifting mast, and wherein a load chain guide roller arrangement extends at an oblique angle to the transverse extent of the lifting mast.

The asymmetric arrangement of a piston and cylinder arrangement on one side of the central longitudinal axis of the lift truck presents a surprising solution. Owing to the asymmetric arrangement of the operator's station, the dead angles behind the two uprights of the lifting mast, also of a telescopic lifting mast, are rather large. The invention makes use of such dead angles. As a result, the asymmetric, i.e. laterally offset arrangement of the operator's station with respect to the central longitudinal axis of the lift truck, just as the laterally offset position of the steering wheel in a vehicle, is practical. In combination with such a design of the vehicle, the visibility through the central region of a framelike lifting mast is substantially improved and it is also possible to use lifting cylinder arrangements relatively large in diameter in such a way that they do not appear in the field of view of the driver.

Such a lifting mast arrangement in itself presents a surprising solution which even in case of a unilateral application of the lifting forces permits a parallel uniform lifting movement. Cooperating guide members can be designed for that purpose.

With the arrangement at least of one lateral lifting cylinder arrangement in a given dead angle the lifting cylinder arrangement is disposed out of the plane of the lifting mast. Preferably, the chain guide roller arrangement provides guidance for the load chain between essentially the centre line of the load carrier and the at least one lifting cylinder arrangement. As a result it is possible to obtain a suitable application of force to the load carrier in conjunction with a laterally arranged lifting cylinder arrangement. In a particularly preferred embodiment of the invention this roller arrangement is mounted on the upper or lower part of a fixed mast section or on an extensible mast section and comprises a carrier arranged at an oblique angle to the transverse plane of the lifting mast. With reference to the roller arrangement preferably at least two chain guide rollers are arranged on a common carrier which is constructed to extend at an oblique angle to the transverse extension of the lifting mast.

In a preferred embodiment, two load chain guide rollers on the carrier are mounted at different heights along the vertical axis of the lifting mast and a reversing roller is correspondingly arranged on a head of a movable piston of the lifting cylinder arrangement.

In a further preferred embodiment the load chain has one end anchored to the fixed section of the mast and extends to the load carrier around the reversing roller and two chain guide rollers arranged at different heights and an abutment for the piston head is arranged on the extensible mast section. As a result it is possible to operate a telescopic lifting mast in such a way that the load carrier is lifted through a predetermined distance until the piston head engages the abutment on the extensible mast section whereupon the latter and the load carrier are moved in the same sense at different velocities in such a way that the load carrier reaches its upper position on the extensible mast section when this has been extended so far that the piston head has lifted the abutment on the extensible mast section to its uppermost position. As the chain guide rollers are arranged in different vertical positions, a further operation of the piston and cylinder arrangement or a further lifting of the movable piston head will result in a lifting of the abutment and a further movement of the load carrier to a greater height. Thus, the invention provides a construction which after the performance of the dead lift the extensible mast section is directly moved by way of the cylinder while the load carrier moves further up to its upper end position.

To provide a particular advantage the load carrier is caused to perform a limited dead lift as the piston head approaches the abutment and, after an extension of the extensible mast section so as to lift its abutment from the piston head is movable through a further lift when the two chain guide rollers are arranged in the upper section of the extensible mast section.

During the use of the truck, the lifting cylinder will be protected from external impacts if the abutment is provided on a rearwardly extending transverse beam of the extensible mast section and the lifting cylinder is arranged within the lateral external periphery of the frame of the extensible mast section underneath this transverse beam.

With respect to the described embodiment it is seen that in addition to the obtaining of a good visibility through the mast, the construction cost is kept low. Furthermore, the hydraulic efficiency and the small construction weight are economical; the latter is particularly important for lift trucks having a counterweight since the part of the weight lying outside the wheel base of the load-handling device must be compensated behind the front wheels by means of a counterweight in consideration of a longitudinal stability factor.

Also with reference to the simple lifting cylinder arrangement and load chain guidance, weight will be saved if the second and third chain guide rollers are arranged in the upper section of the extensible mast section near the lifting cylinder and on one side thereof by way of carrying plates on the upper transverse beam of the frame of the extensible mast section, and extends from the center of the lifting cylinder with an inclination to the chain abutment of the load carrier.

A constructional advantage will also be obtained if a telescopic mast having at least two extensible sections is provided and the basic arrangement described hereinbefore is provided in conjunction with one lifting cylinder effective only for the main lift and an additional dead lift cylinder in a mirror image position to this cylinder on the other side of the carrying frame.

A particularly advantageous solution of this kind lies in that the lifting cylinder arrangement effecting the main lift cooperates with or is connected with an abutment on the adjacent extensible mast section and a dead lift cylinder arrangement is arranged in a mirror image position on the other side of the fixed mast section and has associated with it the chain guide roller arrangement provided on the extensible mast section.

Preferably, the lifting force to be exerted by the main lifting cylinder arrangement, which is longer than the dead lift cylinder arrangement, is reduced in that the lowermost extensible mast section is lifted directly by the main lifting cylinder arrangement.

Just as with a telescopic lifting mast having only one extensible section, a very simple load chain guidance can be obtained where a telescopic lifting mast having more than one extensible section is used and the dead lift is effected by a load chain, which is anchored at one end and extends over a first chain roller supported on a cylinder head and is movable by means of the dead lift cylinder and trained around a second chain roller so as to avoid an oblique pull on the cylinder and is supported on a part of the lowermost extensible mast section, further around a third chain roller equally supported on the lowermost extensible mast section as well as around a fourth chain roller supported on a part of the next higher extensible mast section centrally or approximately centrally of a load carrier arranged to be movable upwardly along said next higher extensible section and to lift the latter to its uppermost position.

An advantageous embodiment of the invention will be obtained if the dead lift cylinder arrangement has a depending piston rod and the chain guide roller arrangement is arranged in the upper zone of the adjacent extensible mast section so that the lifting cylinder and the dead lift cylinder arrangement are arranged in mirror symmetry in plan view. In this way, in an embodiment including a telescopic mast having at least two extensible mast sections and wherein a load chain for the dead lift is supported at one end on the fixed mast section is trained around a movable chain guide roller on the dead lift cylinder arrangement and around a lower chain guide roller on the lowermost extensible mast section to an upper chain guide roller on the second next higher extensible mast section, the lifting cylinder arrangement may directly cooperate with an abutment on said next higher extensible mast section and at least one further load chain extends from the lower end of said next higher extensible mast section and around a chain guide roller on the upper part of the lowermost extensible mast section to the fixed mast section, whereby the chain guide roller arrangement is provided with chain rollers at the lower end of the lowermost extensible mast section and arranged at an oblique angle to the transverse direction of the lifting mast.

For an economical construction and for a small spare parts requirement it is particularly important that the lifting cylinders have the same piston areas whether the telescopic lifting mast has only one extensible mast section for a small dead lift or has more than one extensible mast section.

Since, particular measures are not required in the present arrangement to effect the movements of the dead lift and the main lift cylinders in the necessary sequence, both lifting cylinders can be supplied from one rigid hydraulic conduit at the same time. A fixed pipe will be desirable although a flexible bend may be included to prevent a fracture of the pipes.

The required simplicity in design can be obtained among other things in that chain connections exist between the fixed mast section and the second extensible mast section from below and extend around chain rollers supported on the lowermost extensible mast section.

In a preferred embodiment the chain guide rollers for two load chains are provided laterally and a third load chain is guided from the side to the middle by way of the chain roller arrangement. As a result two carriers can be provided with chain guide rollers arranged at an oblique angle to the transverse extension of the lifting mast.

In a particularly advantageous manner, features of the described lifting mast can be combined with the telescopic lifting mast having only one extensible mast section for a small dead lift and with a telescopic lifting mast having more than one extensible mast section for a large dead lift so as to permit the manufacture of a telescopic lifting mast which has only one extensible mast section and nevertheless a large dead lift. This relates particularly to the arrangement of the lifting cylinder and the load chain.

The invention is hereinafter further described by way of example with reference to the accompanying drawings in which:

FIG. 8 is a schematic representation of the mast of FIG. 7 after the large dead lift has been performed;

FIG. 9 is a view as in FIG. 8 after the entire lift has been performed;

The following description refers to the parts essential to the understanding of the function. Cooperating guide elements even if they are illustrated are not otherwise described as long as they constitute known details.

Figure 10:
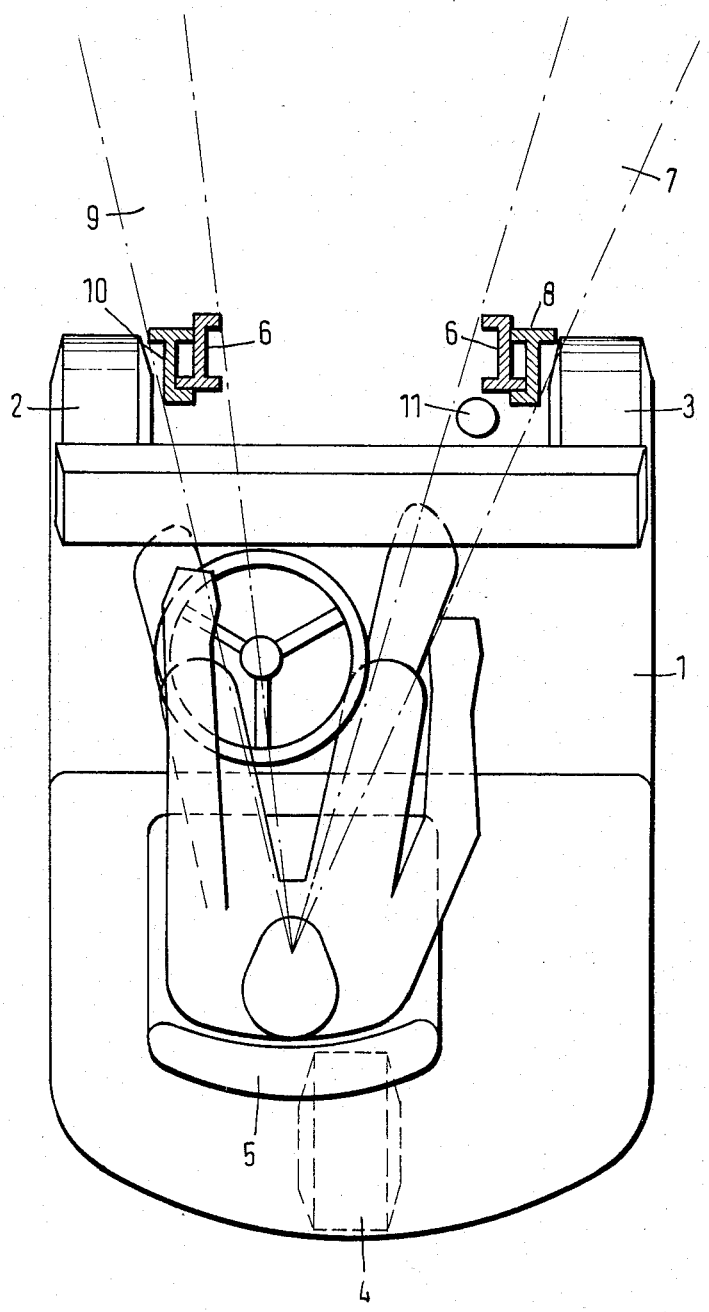
FIG. 10 is a top plan view of a lift truck with a lifting mast according to FIGS. 1 to 3.

The described lifting mast stands as is apparent from FIG. 10 on a lift truck 1 which has, for example, two forward wheels 2, 3 and a steerable drive wheel 4 arranged at the rear. The operator's station 5 is arranged asymmetrically with respect to the central longitudinal axis of the truck, in accordance with FIG. 10, for example on the left thereof.

The mast sections of a lifting mast generally designated 6 are arranged symmetrically with respect to the central longitudinal axis. Owing to the asymmetric arrangement of the operator's station 5 and the dead angle 7 which is due to the upright 8 of the lifting mast 6 is larger than the dead angle 9 which is due to the upright 10. For this reason the lifting cylinder arrangement 11 is arranged within the larger dead angle 7 that is due to the upright 8 and is specifically disposed between the upright 8 and the operator's station 5 so that the lifting cylinder arrangement is protected against external interference.

Figure 1:
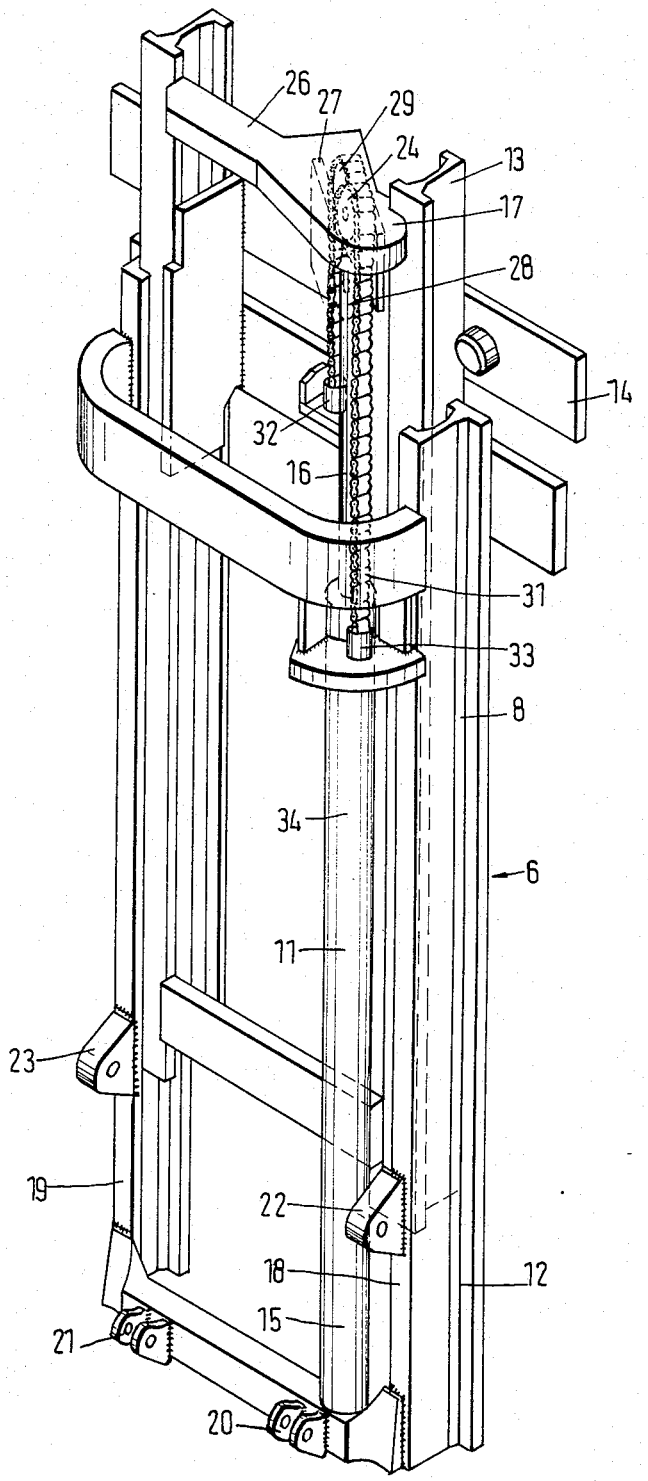
FIG. 1 is a perspective general view of a telescopic lifting mast for a lift truck having one lifting cylinder.
Figure 3:
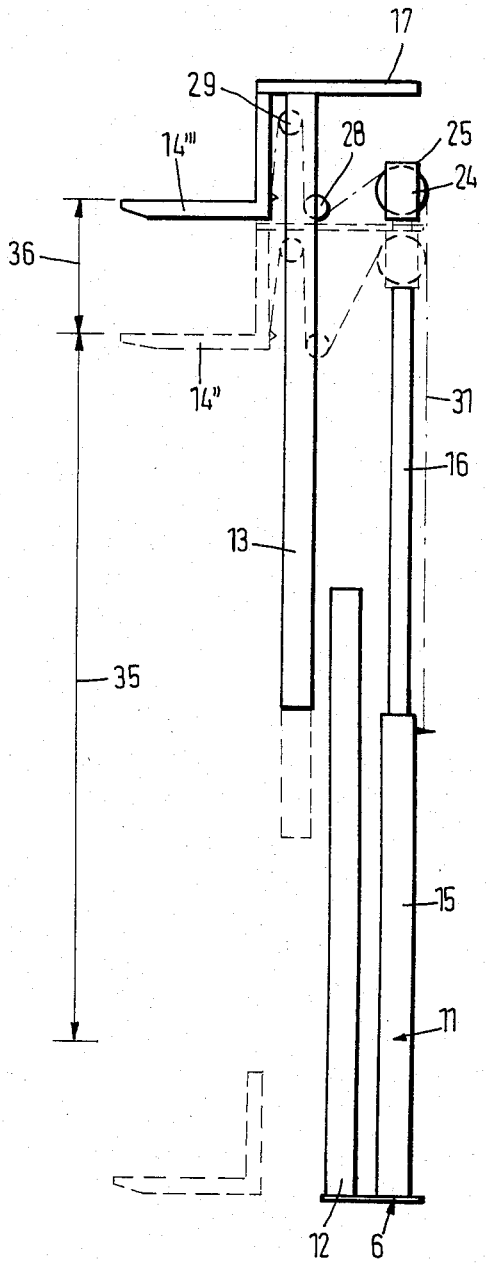
FIG. 3 is a view as in FIG. 2 after the entire lift has been performed.
Figure 2:
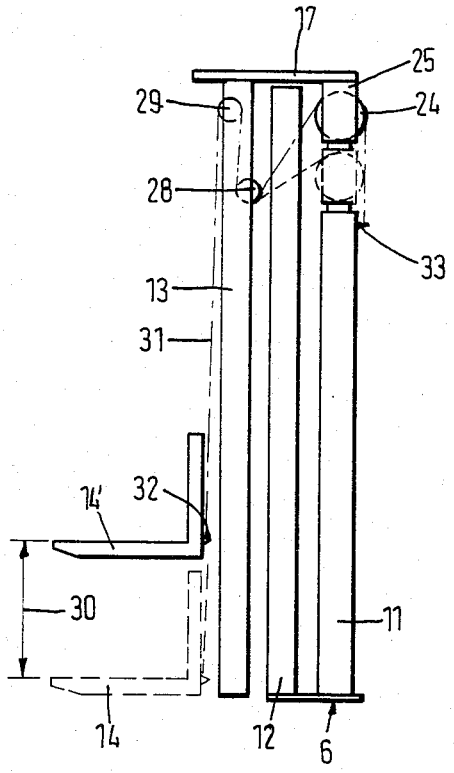
FIG. 2 is a schematic representation of the mast of FIG. 1 after the dead lift has been performed.

In accordance with FIGS. 1 to 3 the lifting mast 6 consists of the fixed mast section 12 and the load carrying extensible mast section 13 suitably guided thereon. Both mast sections comprise spaced apart uprights, which leave between them a wide free viewing area. A load carrier 14 is suitably guided on the extensible mast section 13 and held in alignment with the extensible mast section by guide rollers.

In accordance with FIG. 10 a lifting cylinder arrangement 11 is provided, with reference to FIG. 1, behind the upright 8 of the fixed mast section and of the extensible mast section and includes a cylinder 15, which is supported on the lower part of the fixed mast section, and a piston rod 16, which is movable upwardly to engage an abutment 17, which is secured to and in this embodiment extends rearwardly from the extensible mast section 13. If the lifting cylinder arrangement were provided in front of the lifting mast, the abutment 17 would be provided on the forward side.

It can be seen that mountings 20 to 23 are provided on the uprights 18, 19 of the fixed mast section in order to connect the lifting mast to the lift truck and also to hold it in a defined position with respect to the vertical. Furthermore, it can be seen that the uprights interengage in part by way of lateral flanges. Rollers (not illustrated) are provided for the mutual guidance of the uprights.

In the illustrated embodiment the piston rod 16 of the lifting cylinder arrangement carries at its upper end the piston head 25, which is engageable with the abutment 17 on the extensible mast section and on which the reversing roller 24 is rotatably mounted.

The abutment 17 is, according to FIG. 1, combined with a carrier 26, which is arranged on the extensible mast section 13. That carrier 26 or at least a section 27 thereof extends at an oblique angle to the transverse extension of the lifting mast 6. Two chain guide rollers 28, 29 are supported at different heights in this carrier and are movable upwardly therewith and with the extensible mast section 13.

In this context it is additionally pointed out that the two chain guide rollers 28, 29 are aligned in the direction of the reversing roller 24 arranged on the piston rod 16 at an oblique angle to the transverse extension to the lifting mast, so that a load chain 31 extends from a central fixing point provided on the load carrier 14 vertically upwardly and around the reversing roller 24 to a fixing point 33 on the fixed mast section. In a simple arrangement, the fixing point 33 is disposed at the upper end of the cylinder 34 of the lifting cylinder arrangement 11.

Thus, with reference to FIGS. 2 and 3, it is understood that when the piston rod of the lifting cylinder arrangement 11 is retracted, its piston head 25 and the reversing roller 24 are spaced below the abutment 17. Upon operation of the lifting cylinder the load carrier 14 is lifted out of the dotted line position by a limited dead lift 30 without a movement of the lifting mast. As a result the lifting cylinder arrangement 11 also operates as a dead lift cylinder arrangement. After the dead lift the lift 35 is performed by the extensible mast section 13 so that the load carrier is then in position 14″ and the reversing roller 24 is approximately at the same height as the upper load chain guide roller 29. A further movement of the piston rod 16 results in a lift 36 so that the load carrier is finally in its uppermost position 14‴ in which the abutment 17 is spaced above the piston head 25 as the chain guide rollers 28, 29 are arranged in different heights. Thus, it is seen that in the described embodiment a particularly efficient lifting arrangement is obtained and the spacing between the chain guide rollers 28, 29 can also be larger than illustrated.

The reference to load chains includes also other tensile elements, such as cables or the like.

Figure 4:
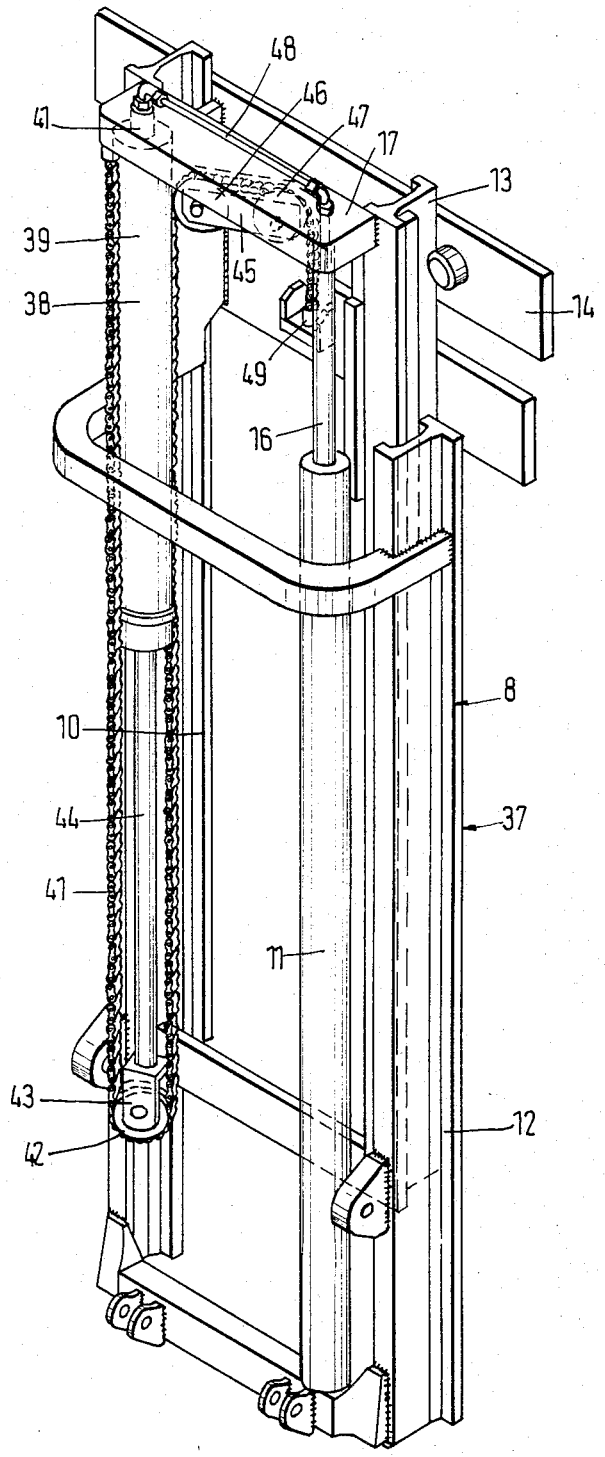
FIG. 4 is a perspective general view of a two-part telescopic lifting mast for a lift truck having a larger dead lift and two lifting cylinders.
Figure 5:
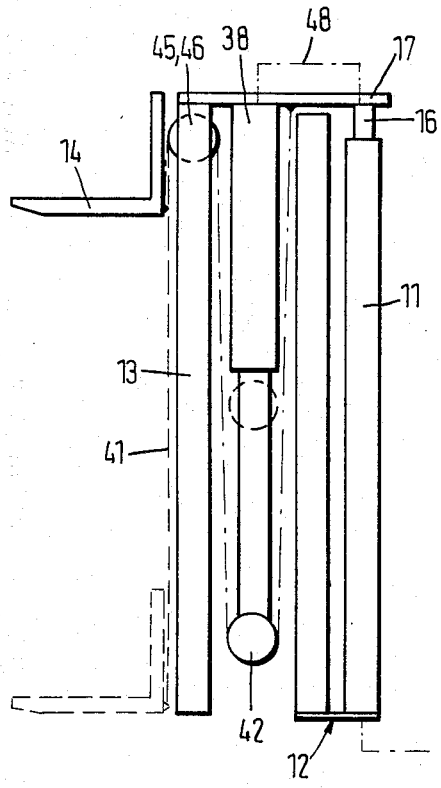
FIG. 5 is a schematic representation of the mast of FIG. 4 after the larger dead lift has been performed.
Figure 6:
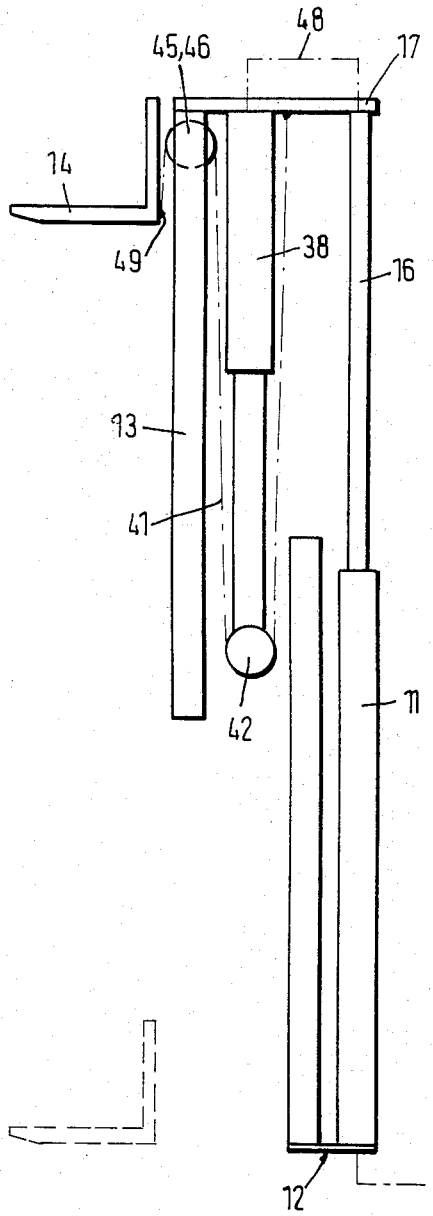
FIG. 6 is a view as in FIG. 5 after the entire lift has been performed.

FIGS. 4 to 6 show a further embodiment in the form of a two-part telescopic lifting mast 37 having a larger dead lift. As in the previous embodiment, a fixed mast section 12 and an extensible mast section 13 are provided and the latter has an abutment 17 for the lifting cylinder arrangement 11. In this embodiment however the piston rod 16 is connected to or constantly engages the abutment 17. The lifting cylinder arrangement 11 is arranged as in the previously described embodiment laterally in the region of the upright 8 of the lifting mast. According to FIGS. 4 and 5, however a second lifting cylinder arrangement 38 is provided, which depends from the upper end of the extensible mast section 13 and is disposed in the dead angle that is due to the upright 10. The cylinder 39 is fixed to an abutment 40 at the upper end of the extensible mast section 13. To this cylinder or to the abutment 40 a load chain 41 is fixed, which extends around a reversing roller 42 on the piston head 43 of a piston rod 44 of the lifting cylinder arrangement 38 and at an oblique angle to the transverse extension of the lifting mast 37 to a carrier 45 on which, in this case for example, two chain guide rollers 46, 47 are so supported at the same height that the outgoing course of the load chain extends to a central abutment 49 of the load carrier 14. The carrier 45 is thereby fixed to the extensible abutment 17 or 40 and is movable vertically together with the extensible mast section.

As can be seen from FIGS. 5 and 6, the initial operation of the lifting cylinder arrangement 38, which is also called dead lift cylinder arrangement, causes the reversing roller 42 to be lowered to the position 42. As a result the load chain 41 lifts the load carrier 14 from its lower position to the illustrated position at the upper end of the extensible mast section 13. Thereafter the lifting cylinder arrangement 11 is extended to the position shown in FIG. 6 so that the extensible mast section 13 is also moved to its upper position. Both lifting cylinder arrangements 11 and 38 communicate with each other through a rigid conduit 48, which may include a piston rod. With reference to the loading, the use of equal piston areas will ensure that the dead lift cylinder arrangement 38 will be extended before pressure fluid is supplied to the lifting cylinder arrangement 11. A flexible bend is preferably included in the rigid pipe conduit 48.

Figure 7:
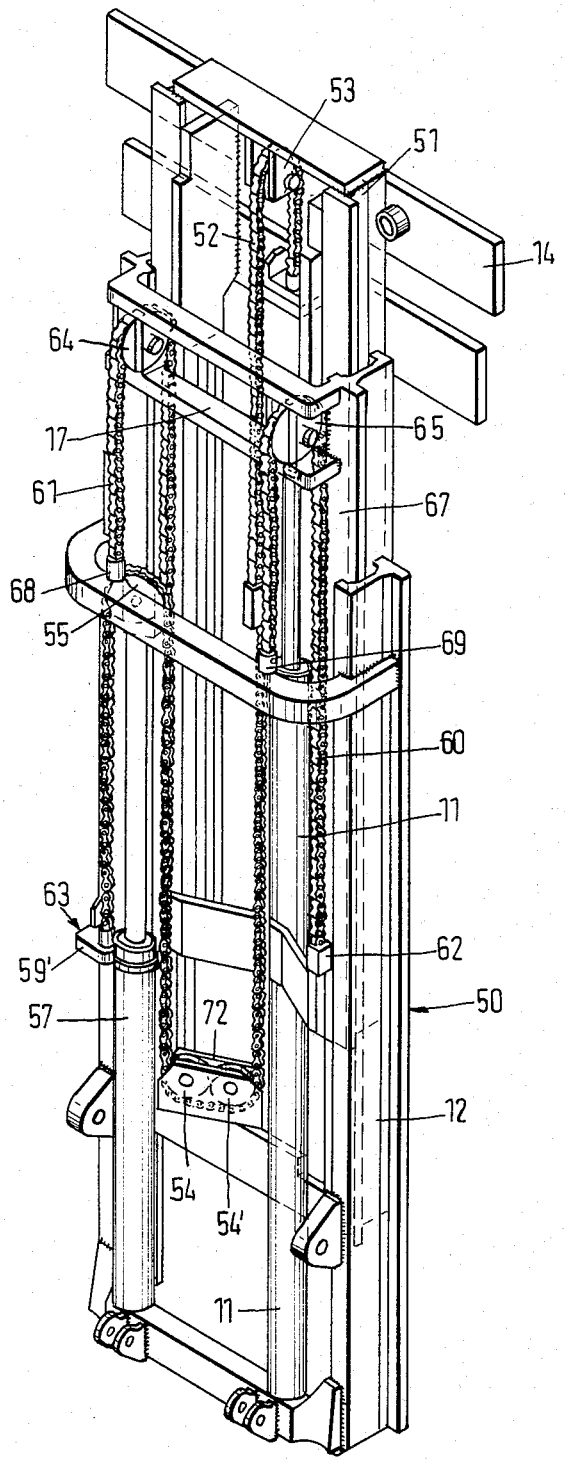
FIG. 7 is a perspective general view of a three-part telescopic mast having two lifting cylinders.

FIGS. 7 to 9 show a three-part telescopic lifting mast 50 having a fixed mast section 12. A lifting cylinder arrangement 11 is connected to the mast section 12 and cooperates with an abutment 17 on the lower extensible mast section 13 in the manner described with reference to FIGS. 4 to 6. In the described embodiment one upper extensible mast section 51 is vertically guided on the lower extensible mast section and the load carrier 14 is vertically movable thereon. The load carrying chain 52 controlling the load carrier 14 extends around a reversing roller 53 at the upper end of the upper extensible mast section 51 and at least one reversing roller 54 at the lower end of the lower extensible mast section 13 to a reversing roller 55 on the piston rod 56 of a dead lift cylinder arrangement 57, which in this case is arranged on the base 58 of the fixed mast section 12. The load carrying chain 52 is fixed on this base for example at 59 (FIG. 9) or 59' (FIG. 7). The axis of the reversing roller 53 extends in the transverse direction on the mast. As a result a chain connector is included in the load carrying chain in the region between the reversing roller 53 and a reversing roller 54' near the reversing roller 54 and connects the vertical load chain sections to each other. The upper extensible mast section 51 is, as seen in FIG. 7, moved by two load carrying chains 60, 61, which at their lower ends 62, 63 are connected to the upper extensible mast section 51 and extend around respective reversing rollers 64, 65 at the upper end of the uprights 66, 67 of the lower extensible mast section and from there to fixing points 68, 69 in the region of the base or a corresponding part of the fixed mast section. The reversing rollers 54, 54' are also arranged in this embodiment on a carrier 72, which extends at an angle to the transverse direction of the travelling mast, at least in the section in which the reversing rollers 54, 54' are supported.

In this embodiment there results in accordance with FIG. 8 initially a dead lift 70 of the load carrier 14 over the upper extensible mast section 51. Thereafter the lifting cylinder arrangement 11 becomes effective to move the lower and upper extensible mast sections 13 and 51 at the same time. The main lifting cylinder arrangement 11 and the dead lift cylinder arrangement 57 communicate with each other through a rigid parallel conduit 71 and have equal piston areas so that their piston rods are extended in succession.

The invention is obviously not limited to the illustrated exemplary embodiments, which can be changed in several ways without departing from the basic concept of the invention. So, for example, instead of the single load chains extending at the center of the mast, two load chains may be provided near the uprights in conjunction with different chain roller arrangements and a pulling on extensible mast sections at an angle can be avoided by a suitable guidance of the chain. Besides, lifting cylinders having more than one extensible parts may be used and other alterations may be adopted.

We claim:

1. In a lift truck comprising a chassis having a central horizontally extending longitudinal axis, a lifting frame including a lower portion which is carried by said chassis and vertically immovable relative thereto, said lifting frame comprising telescopic mast portions including uprights spaced apart in a predetermined horizontal direction extending transversely of the longitudinal axis, said lifting frame having a forward side and a rearward side, an upwardly directed hydraulic lifting cylinder arrangement, which is disposed entirely on one side of said central longitudinal axis and includes an extensible piston rod, a load carrier which is guided by said lifting frame and extends in said predetermined horizontal direction and is guided by said lifting frame to move along the same relative to said chassis, reversing means carried by said lifting frame and extending above the lower end of said load carrier, flexible tensile means having a first portion engaging said piston rod, a second portion trained around said reversing means, and a third portion depending from said reversing means to said load carrier and secured to the latter, said flexible tensile means being arranged to lift said load carrier relative to said chassis in response to an extension of said piston rod, and an operator's station which is provided on said chassis behind said lifting frame on the rearward side thereof and is laterally offset with respect to said central longitudinal axis so that each of said uprights defines a predetermined dead angle for the view of an operator located in said operator's station, the improvement residing in that, in combination, said lifting cylinder arrangement is disposed in one of said dead angles, said tensile means are connected to said load carrier at the center of its extent in said predetermined horizontal direction between said uprights, said reversing means comprise roller means which guide said tensile means so that in a top plan view said tensile means extends at an oblique angle to said horizontal direction, said roller means are disposed a portion of said load carrier near the center of its extent in said predetermined horizontal direction and said lifting cylinder arrangement, said roller means comprise a roller carrier, which extends at an oblique angle to said predetermined horizontal direction in the top plan view and two guide rollers rotatably mounted on said roller carrier for rotation on respective axes which include an oblique angle with respect to said longitudinal axis, said flexible tensile means are trained over said guide rollers, said piston rod is upwardly extensible, said two rollers have apices at different elevations, said reversing means includes a deflecting roller rotatably mounted at the top end of said piston rod, and said flexible tensile means are trained around said deflecting roller.

2. In a lift truck comprising a chassis having a central horizontally extending longitudinal axis, a lifting frame including a lower portion which is carried by said chassis and vertically immovable relative thereto, said lifting frame comprising telescopic mast portions including uprights spaced apart in a predetermined horizontal direction extending transversely of the longitudinal axis, said lifting frame having a forward side and a rearward side, an upwardly directed hydraulic lifting cylinder arrangement, which is disposed entirely on one side of said central longitudinal axis and includes an extensible piston rod, a load carrier which is guided by said lifting frame and extends in said predetermined horizontal direction and is guided by said lifting frame to move along the same relative to said chassis, reversing means carried by said lifting frame and extending above the lower end of said load carrier, flexible tensile means having a first portion engaging said piston rod, a second portion trained around said reversing means, and a third portion depending from said reversing means to said load carrier and secured to the latter, said flexible tensile means being arranged to lift said load carrier relative to said chassis in response to an extension of said piston rod, and an operator's station which is provided on said chassis behind said lifting frame on the rearward side thereof and is laterally offset with respect to said central longitudinal axis so that each of said uprights defines a predetermined dead angle for the view of an operator located in said operator's station, the improvement residing in that, in combination, said lifting cylinder arrangement is disposed in one of said dead angles, said tensile means are connected to said load carrier at the center of its extent in said predetermined horizontal direction between said uprights, said reversing means comprise roller means which guide said tensile means so that in a top plan view said tensile means extends at an oblique angle to said horizontal direction, said roller means are disposed between a portion of said load carrier near the center of its extent in said predetermined horizontal direction and said lifting cylinder arrangement, said roller means comprise a roller carrier, which extends at an oblique angle to said predetermined horizontal direction in the top plan view and two guide rollers rotatably mounted on said roller carrier for rotation on respective axes which include an oblique angle with respect to said longitudinal axis, said flexible tensile means are trained over said guide rollers, said lifting frame includes an extensible frame section carrying said reversing means and a fixed frame section including said lower portion of said lifting frame, wherein said tensile means are fixed to said fixed frame section, said extensible frame section carries an abutment, said piston rod carries at its top end a head member and is upwardly extensible to move said head member into engagement with said abutment, and said two guide rollers are disposed in different elevations and are aligned in a direction that is at an oblique angle to said predetermined horizontal direction in a top plan view.

3. The improvement set forth in claim 1 or 2, wherein said lifting cylinder arrangement is disposed between said operator's station and the rearward side of said lifting frame.

4. The improvement set forth in claim 1 or 2, wherein said lifting frame is disposed between said lifting cylinder arrangement and said operator's station.

5. The improvement set forth in claim 1 or 2, wherein said flexible tensile means comprise chain means.

6. The improvement set forth in claim 1 or 2 as applied to a lift truck in which said lifting frame includes an extensible frame section carrying said reversing means and a fixed frame section that includes said lower portion of said lifting frame, wherein said extensible frame section comprises a rearwardly extending cross member located on the rearward side of said lifting frame and provided with an abutment, and said lifting cylinder is disposed under said cross member within the lateral outside contour of said extensible frame section and has a piston rod that is upwardly extensible to engage said abutment.

7. The improvement set forth in claim 2, wherein said piston rod is adapted to assume a predetermined lowermost position and predetermined first, second and third upper positions, said extensible frame section is adapted to assume a predetermined lowermost position and predetermined first and second upper positions, said load carrier is adapted to assume a predetermined lowermost position and predetermined first, second and third upper positions, the vertical distance between said first and second upper positions of said extensible frame section exceeds the vertical distance between said second and third upper positions of said piston rod, the vertical distance between said first and second upper positions of said load carrier exceeds the vertical distance between said first and second upper positions of said extensible frame section, said head member is spaced below said abutment when said piston rod and said extensible frame section are in their lowermost positions, said head member engages said abutment when said piston rod is in its first upper position and said extensible frame section is in its lowermost position, said piston rod is arranged to move said extensible frame section from its lowermost position to its first upper position as said piston rod moves from its first upper position to its second upper position, said tensile means are arranged to support said load carrier in its lowermost position when said piston rod is in its lowermost position, to support said load carrier in its first upper position when said piston rod is in its first upper position, to move said load carrier to its second upper position as said piston rod moves from its first to its second upper position, to move said extensible frame section from its first to its second upper position and said load carrier section from its second to its third upper position as said piston rod moves from its second to its third upper position, and to move said load carrier from its third to its fourth upper position as said piston rod moves from its third to its fourth upper position, and said two guide rollers are rotatably mounted on the extensible frame section near the upper end thereof.

* * * * *